US006554659B2

(12) United States Patent
Kikuchi et al.

(10) Patent No.: US 6,554,659 B2
(45) **Date of Patent: *Apr. 29, 2003**

(54) CONNECTOR CONTACT AND METHOD OF MANUFACTURING THE SAME

(75) Inventors: Kazuya Kikuchi, Tokyo (JP); Kenichi Hatakeyama, Iwate (JP)

(73) Assignee: NEC Tokin Corporation, Sendai (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/739,009

(22) Filed: Dec. 19, 2000

(65) Prior Publication Data

US 2001/0004568 A1 Jun. 21, 2001

(30) Foreign Application Priority Data

Dec. 20, 1999 (JP) ..... 11-361903

(51) Int. Cl.[7] ..... H01R 11/22
(52) U.S. Cl. ..... 439/857
(58) Field of Search ..... 439/857, 843, 439/862, 891, 637, 80, 81, 83, 884, 238, 856

(56) References Cited

U.S. PATENT DOCUMENTS 3,838,388 A * 9/1974 Bauerle et al. ..... 439/857
4,743,208 A * 5/1988 Weisenburger ..... 439/398

FOREIGN PATENT DOCUMENTS

JP 7-326417 12/1995

* cited by examiner

*Primary Examiner*—Renee Luebke
*Assistant Examiner*—Phuong Nguyen
(74) *Attorney, Agent, or Firm*—McGinn & Gibb, PLLC

(57) ABSTRACT

A connector contact has a main body portion, a pair of elastic pieces extending like beams on the same side from two sides of the main body portion, and contact portions respectively formed at distal ends of the elastic pieces, to come into contact with a male contact inserted between the contact portions. The pair of elastic pieces have, at their distal ends, protrusions at which the contact portions are to be arranged and each of which projects in a lateral direction opposite to the other elastic piece. The pair of elastic pieces are deformed by twisting or bending, so that the contact portions oppose each other.

10 Claims, 7 Drawing Sheets

CONNECTOR CONTACT AND METHOD OF MANUFACTURING THE SAME

BACKGROUND OF THE INVENTION

1. Field of the Invention

The present invention relates to a connector contact capable of coping with a decrease in pitch and shortening the time required for assembly.

2. Description of the Prior Art

As an example of a conventional connector contact, a so-called tulip-shaped contact 100 with the structure shown in FIG. 1 is available. The contact 100 is comprised of a main body portion 103 bent to have a U-shaped section and having a base plate portion 101 and a pair of parallel upright plate portions 102 standing vertically from the two edges of the base plate portion 101, elastic pieces 104 extending like beams in the same direction from the respective upright plate portions 102 of the main body portion 103, and contact portions 105 formed at the distal ends of the elastic pieces 104. When a male contact 106 is pushed between the contact portions 105, the elastic pieces 104 elastically deform, as they are forced apart by the male contact 106, to separate the contact portions 105 apart from each other so as to receive the inserted male contact 106 between them. Simultaneously, the contact portions 105 are urged against the male contact 106 by the elastic forces of the elastic pieces 104, so that they come into reliable contact with the male contact 106.

Assume that a connector is to be fabricated by building this contact 100 into a connector housing 107 shown in FIG. 3. First, a flat plate member is punched to form a flat plate-like blank in which a plurality of contact forming portions 100A each shown in FIG. 2 are lined at the equal pitch in a common carrier 110 shown in FIG. 3. The contact portions 105 are formed at the elastic pieces 104 of each contact forming portion 100A of this blank so as to make the elastic pieces 104 serve as contacts, and after that the contact forming portion 100A is bent at bending lines indicated by alternate long and short dashed lines in FIG. 2 to have the shape of the contact 100. As shown in FIG. 3, the plurality of contacts 100 held by the carrier 110 in this manner are inserted in holes 111 in the connector housing 107 simultaneously, and then the individual contacts 100 are separated by cutting.

In recent years, a pitch W0 shown in FIG. 3, with which the contacts 100 are disposed in the connector, is greatly narrowed. The mainstream pitch W0 is 2.0 mm, and a connector with a pitch of about 1.5 mm is also under development. In order to cope with this decrease in pitch, the pitch with which the contact forming portions 100A, serving as a developing form of the contacts 100, are to be disposed must also be narrowed. With the contact 100 with the shape described above, when the main body portion 103 with the U-shaped section is developed, its width W2 shown in FIG. 2 is large, and a decrease in pitch is accordingly limited. More specifically, with the contact 100 with the shape described above, after the male contact 106 is fitted in it, it clamps the male contact 106 with contact forces, thereby exhibiting its connecting function. In order to clamp the male contact 106 in this manner, the main body portion 103 that supports the proximal portions of the elastic pieces 104 so that they oppose each other must be bent into a U-shape, and the U-shaped main body portion 103 must have such a size that it can sufficiently receive the male contact 106 (more specifically, when the male contact has a width of 0.5 mm, the main body portion 103 must have an inner width of about 1.5 mm). Consequently, the width W2 described above increases undesirably.

For this reason, with these contacts 100, a pitch W2' (shown in FIG. 3) of the contact forming portions 100A in the blank, which is inevitably larger than the width W2 obtained by developing each main body portion 103, must be twice the pitch W0 with which the holes 111 are formed in the connector housing 107, the plurality of contacts 100 held by the carrier 110 must be inserted in every second holes 111 of the connector housing 107, and similarly the plurality of contacts 100 held by another carrier 110 must be inserted in the remaining every second holes 111. Otherwise, a decrease in pitch cannot be coped with (more specifically $W2 \leqq W2' = 2 \times W0$).

Then, however, two steps are needed to dispose the contacts 100, and consequently, the time required for assembly increases undesirably. If the width W2 is large, the amount of material necessary for forming each contact 100 increases, leading to an increase in cost.

As another example of the connector contact, a so-called fork-shaped contact 120 with the structure shown in FIG. 4 is available. This contact 120 has a flat plate-like shape as a whole, and is comprised of a main body portion 121, a pair of elastic pieces 122 extending like beams from the two sides of the main body portion 121, and contact portions 123 respectively formed at the distal ends of the elastic pieces 122. When a male contact is pushed between the contact portions 123, the elastic pieces 122 elastically deform, as they are forced apart by the male contact, to separate the contact portions 123 apart from each other so as to receive the inserted male contact between them. Simultaneously, the contact portions 123 are urged against the male contact by the elastic forces of the elastic pieces 122, so that they come into contact with the male contact.

Assume that a connector is to be fabricated by building this contact 120 in a connector housing. First, a flat plate member is punched to form a flat plate-like blank in which a plurality of contacts 120 each with the shape described above are lined at the equal pitch, and after that the plurality of contacts 120 are inserted in the holes in the connector housing simultaneously.

With the contacts 120, since the main body portions 121 need not be formed to have a U-shaped section like that of the main body portion 103, the width of the contact 120 can be decreased, and accordingly the pitch with which the contacts are disposed in the blank can also be decreased. Even when coping with a decrease in pitch with which the contacts are to be disposed, the contacts 120 can be inserted in the adjacent holes of the connector housing simultaneously with one blank. As a result, the time required for assembly can be shortened, and the amount of material necessary for forming each contact 120 decreases, leading to a decrease in cost.

In the contact 120 with this structure, since those surfaces of its contact portions 123 which come into contact with a male contact 106 are low-smoothness sheared sections formed by punching, contact error undesirably occurs.

Since the contact portions 123 and main body portion 121 are located on the same plane, the male contact cannot have a sufficiently large insertion length due to the problem of interference with the main body portion 121, and the male contact can be sometimes disengaged easily during use.

Japanese Unexamined Patent Publication No. 7-326417 discloses a contact that can solve the problem on contact error of the contact 120 described above. This contact is a fork-shaped contact comprised of a main body portion, a pair of elastic pieces extending like beams in the same direction from two sides of the main body portion, and contact portions respectively formed at the distal ends of the elastic pieces. The elastic pieces are twisted midway, so those portions of the contact portions which come into contact with a male contact form high-smoothness rolled surfaces.

Even in this contact, since the contact portions and the main body portion are located on the same plane, the male contact cannot have a sufficiently large insertion length due to the problem of interference with the main body portion, and the male contact can be sometimes disengaged easily during use.

SUMMARY OF THE INVENTION

The present invention has been made in view of the above situations in the prior art, and has as its object to provide connector contact which can cope with a decrease in pitch, shorten the time required for assembly, decrease the cost, come into contact with a male contact with high-smoothness rolled surfaces, and assure a sufficiently large insertion length of the male contact.

In order to achieve the above object, according to the first main aspect of the present invention, there is provided a connector contact having a main body portion, a pair of elastic pieces extending like beams on the same side from two sides of the main body portion, and contact portions respectively formed in distal ends of the elastic pieces, to come into contact with a male contact inserted between the contact portions, wherein the pair of elastic pieces have, at the distal ends thereof, protrusions at which the contact portions are to be arranged and each of which projects in a lateral direction opposite to the other elastic piece, and the pair of elastic pieces are deformed by twisting or bending, so that the contact portions oppose each other.

In this manner, the pair of elastic pieces extending like beams on the same side from two sides of the main body portion have, at their distal ends, the protrusions at which the contact portions are to be arranged and each of which projects in the lateral direction opposite to the other elastic piece, and the pair of elastic pieces are deformed by twisting or bending, so that the contact portions arranged on the protrusions oppose each other. Therefore, the main body portion need not be formed to have a C-shaped section, and the width of the contact can be decreased. Even when coping with a decrease in contact pitch of a connector housing, a plurality of contacts made from one blank and connected to each other can be inserted into adjacent holes of the connector housing simultaneously, so that the time required for assembly can be shortened, and the amount of material necessary for forming each contact can be decreased, thus achieving cost reduction.

The pair of elastic pieces are deformed by twisting or bending, so that their contact portions oppose each other. Accordingly, those portions of the contact portions with which the contact portions come into contact with the male contact can form high-smoothness rolled surfaces. Hence, the contact portions can come into contact with the male contact with the high-smoothness rolled surfaces.

The pair of elastic pieces have, at their respective distal ends, the protrusions at which the contact portions are to be arranged and each of which projects in the lateral direction opposite to the other elastic piece, and the pair of elastic pieces are deformed by twisting or bending, so that the contact portions oppose each other. Accordingly, the contact portions can be arranged at positions shifted from that of the main body portion. Hence, the male contact can have a sufficiently large insertion length.

According to one subsidiary aspect of the present invention, in the connector contact according to the first main aspect described above, the pair of elastic pieces are deformed by bending, so that the contact portions oppose each other.

In this manner, the pair of elastic pieces are deformed by bending, so that the contact portions oppose each other. Therefore, when compared to a case wherein the contact portions are made to oppose each other by deforming the pair of elastic pieces by twisting, the number of steps can be decreased, and the contact portions can have high precision.

According to the second subsidiary aspect of the present invention, in the connector contact according to the first subsidiary aspect described above, the pair of elastic pieces are deformed by bending at linear portions extending in the protrusions along an inserting direction of the male contact, so that the contact portions oppose each other.

In this manner, the pair of elastic pieces are deformed by bending at the linear portions extending in the protrusions along the inserting direction of the male contact, so that the contact portions oppose each other. Therefore, the punch and die of the press can have simple shapes. Accordingly, the manufacturing cost can be reduced.

According to the third subsidiary aspect of the present invention, in the connector contact according to the first subsidiary aspect described above, each of the pair of elastic pieces is deformed by bending at a first linear portion arranged closer than the protrusion of one elastic piece to the other elastic piece, and a second linear portion extending obliquely from the first linear portion on a side closer to the main body portion to an outer end of the elastic piece, so that the contact portions oppose each other.

In this manner, each of the pair of elastic pieces is deformed by bending at the first linear portion arranged closer than the protrusion of one elastic piece to the other elastic piece, and the second linear portion extending obliquely from the first linear portion on the side closer to the main body portion to the outer end of the elastic piece, so that the contact portions oppose each other. Therefore, slant portions can be formed at the proximal portions of the protrusions closer to the main body portion. The slant portions can accordingly prevent stress concentration at the proximal portions of the protrusions and can improve the strength.

As the strength is improved, when the male contact is inserted between the contact portions, the contact portions can be separated apart from each other without changing their postures, and consequently they can come into good contact with the male contact.

Since each of the elastic pieces is bent at the first linear portion arranged inner than its protrusion to extend along the inserting direction of the male contact, the distance between the two protrusions before bending can be further decreased while assuring the heights of the protrusions after bending. This can cope with a further decrease in contact pitch.

According to the fourth subsidiary aspect of the present invention, in the connector contact according to any one of the aspects described above, the protrusions on the sides closer to the main body portion have slant portions which slant such that the closer to the main body portion, the smaller their projecting amounts.

In this manner, the protrusions on the sides closer to the main body portion have the slant portions which slant such that the closer to the main body portion, the smaller their projecting amounts. Thus, these slant portions can prevent stress concentration at the proximal portions of the protrusions and can improve the strength.

As the strength is improved, when the male contact is inserted between the contact portions, the contact portions can be separated apart from each other without changing their postures, and consequently they can come into good contact with the male contact.

According to the second main aspect of the present invention, there is provided a method of manufacturing a connector contact which has a main body portion and a pair of elastic pieces extending like beams on the same side from two sides of the main body portion, and in which distal ends of the pair of elastic pieces have protrusions at which contact portions are to be arranged and each of which projects in a lateral direction opposite to the other elastic piece, the contact portions being made to oppose each other by deforming the pair of elastic pieces by bending, comprising the steps of deforming the distal ends of the main body portion, at which the pair of elastic pieces are to be formed, by bending so that the contact portions oppose each other, and punching an intermediate portion of the distal end of the main body portion in a longitudinal direction into a predetermined length to separately form the pair of elastic pieces.

In this manner, after the distal end of the main body portion is deformed by bending, the intermediate portion of the distal end of the main body portion is punched to separately form the pair of elastic pieces. Therefore, bending deformation can be performed while the strength of the distal end of the main body portion is maintained, so that the precision of bending deformation can be improved greatly.

The above and many other objects, features and advantages of the present invention will become manifest to those skilled in the art upon making reference to the following detailed description and accompanying drawings in which preferred embodiments incorporating the principle of the present invention are shown by way of illustrative examples.

BRIEF DESCRIPTION OF THE DRAWINGS

FIGS. 1 to 4 show prior arts, in which FIG. 1 is a perspective view showing an example of a conventional connector contact, FIG. 2 is a plan view showing a blank for the connector contact shown in FIG. 1, FIG. 3 is a perspective view showing the connector contact shown in FIG. 2 before it is inserted in a connector housing, and FIG. 4 is a perspective view showing another example of a conventional connector contact;

DETAILED DESCRIPTION OF THE PREFERRED EMBODIMENTS

Several preferred embodiments of the present invention will be described with reference to the accompanying drawings.

Figure 1:
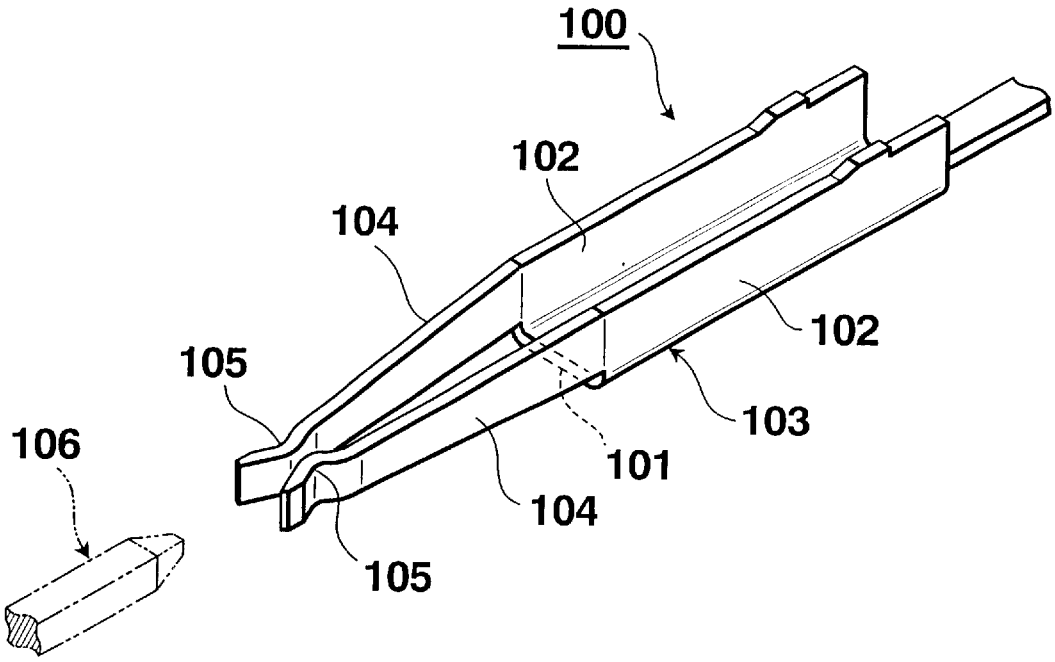
FIG. 1 PRIOR ART
Figure 2:
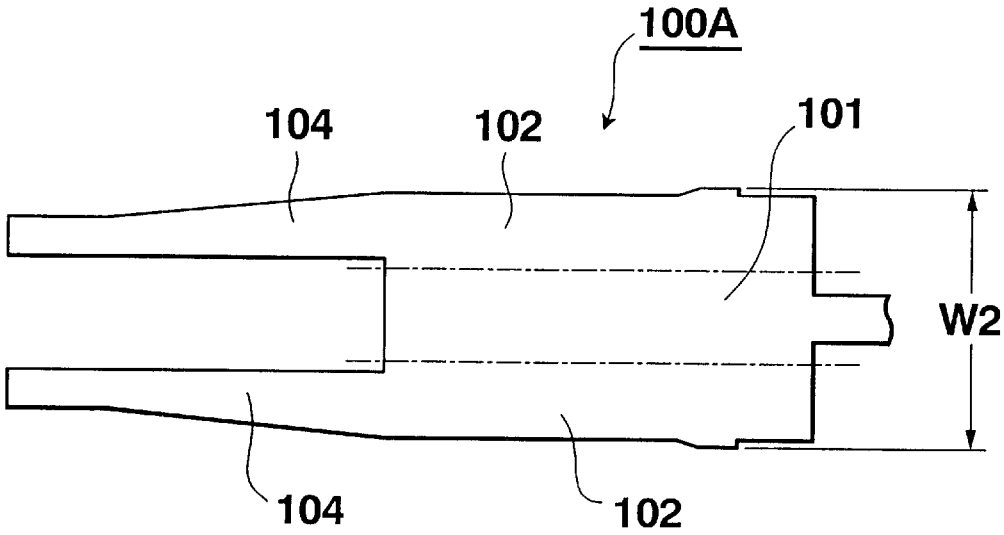
FIG. 2 PRIOR ART
Figure 3:
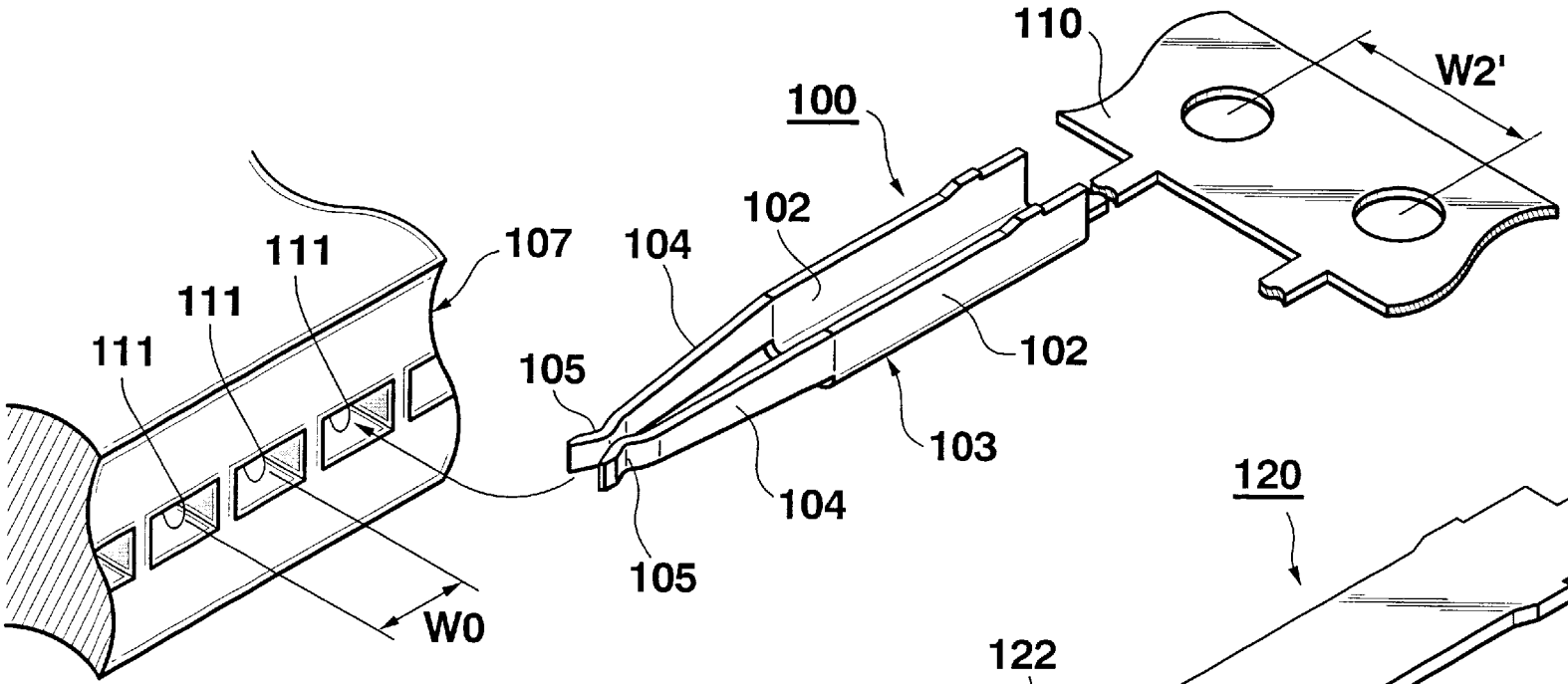
FIG. 3 PRIOR ART
Figure 4:
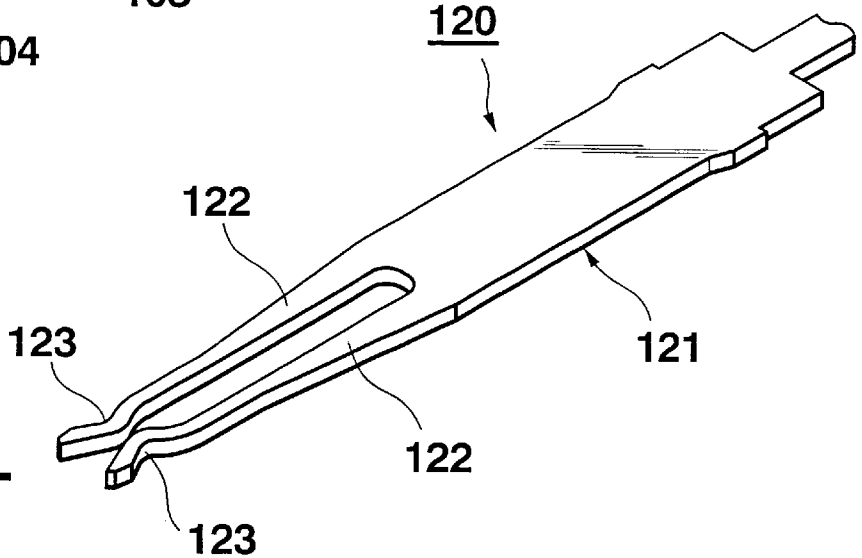
FIG. 4 PRIOR ART
Figure 5:
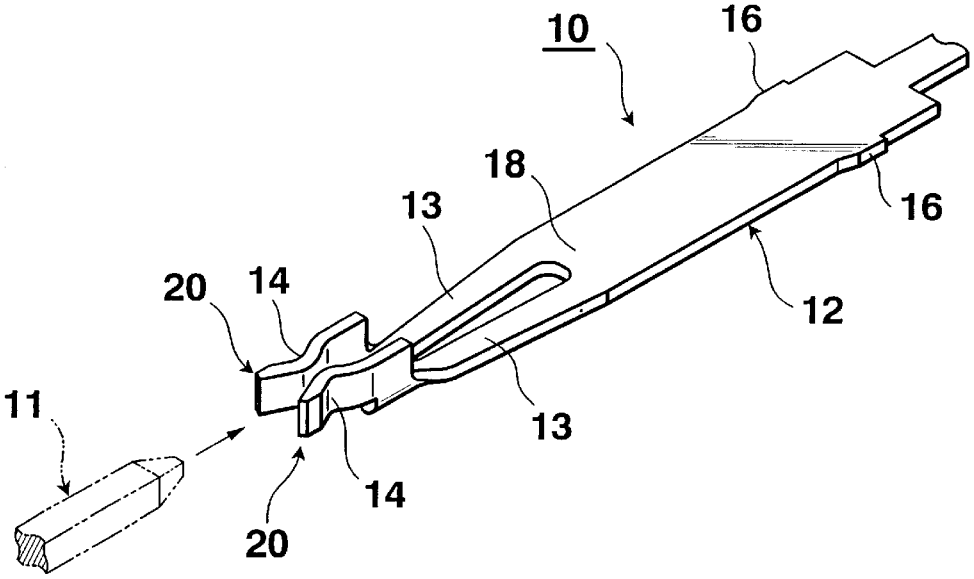
FIG. 5 is a perspective view showing a connector contact according to the first embodiment of the present invention.

A connector contact (to be simply referred to as a contact hereinafter) 10 according to the first embodiment is a female contact to fit on a rectangular prismatic male contact 11 with a tapered distal end, as shown in FIG. 5, and has a main body portion 12, a pair of elastic pieces 13 extending like beams on the same side from the two sides of the main body portion 12, and contact portions 14 respectively formed at the distal ends of the elastic pieces 13. The contact 10 is elongated and flat as a whole, and is specular-symmetrical about the center line along the longitudinal direction.

For example, the contact 10 is formed by plating phosphor bronze by gilt finish with an underlying nickel layer, and has a thickness of about 0.2 mm. When connecting connectors, the male contact 11 is linearly inserted in the contact 10 parallel to the longitudinal direction of the contact 10.

The main body portion 12 is an elongated flat plate as a whole, and projections 16 projecting outward in the widthwise direction are formed on the two sides in the widthwise direction of the main body portion 12.

The pair of elastic pieces 13 extend from the two sides in the widthwise direction at one end in the longitudinal direction of the main body portion 12 to separate from each other along the longitudinal direction of the main body portion 12, and their extending distal ends are slightly slanted to come close to each other. Those portions of the pair of elastic pieces 13 which are to be integrally connected to the main body portion 12 are arcuatedly chamfered (so-called curvature chamfering). Projections 17 are formed on the opposing sides of the respective distal ends of the pair of elastic pieces 13 to project so as to come close to each other, such that their opposing surfaces are parallel to each other.

The pair of elastic pieces 13 have flat portions 18 which form the same plane as the main body portion 12 on most of their main body portion 12 sides. Upright portions 20 are formed on the outer sides in the widthwise direction of the respective distal ends of the pair of elastic pieces 13 to stand upright substantially vertically from the flat portions 18 so they have opposing surfaces.

The upright portions 20 of the pair of elastic pieces 13 are formed roughly in the following manner.

Figure 6:
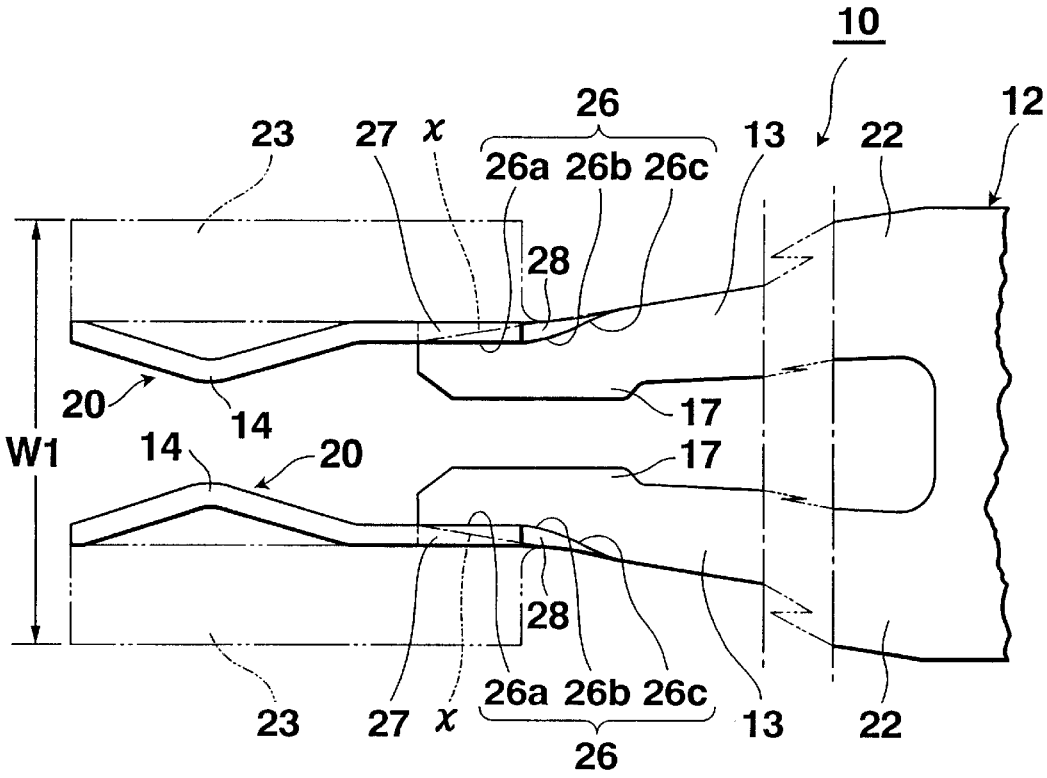
FIG. 6 is a partial enlarged plan view of the connector contact shown in FIG. 5.

As apparent from the exploded plan view indicated by alternate long and two short dashed lines of FIG. 6, elastic piece proximal portions 22 flush with the main body portion 12 and extending from the main body portion 12 like beams, and the elastic pieces 13 respectively extending like beams from the elastic piece proximal portions 22 and flush with the proximal portions 22 are formed. A blank is prepared in which a pair of protrusions 23 flush with the elastic pieces 13 are formed on the outer sides in the widthwise direction of the respective distal ends of the elastic pieces 13. In FIG. 6, boundaries between the elastic pieces 13 and protrusions 23 are indicated by alternate long and short dashed lines X.

Each of the pair of elastic pieces 13 is deformed by bending at a corresponding bending line 26 comprised of a first linear portion 26*a* arranged on a side closer than the boundary line X between it and its protrusion 23 to the other elastic piece 13 and parallel to the longitudinal direction (i.e., the inserting direction of the male contact 11) of the contact 10, a second linear portion 26*b* extending obliquely from the corresponding first linear portion 26*a* on the main body portion 12 side to the neighboring outer end of the elastic piece proximal portion 22 closer to the main body portion 12 than the protrusion 23, and a curved portion 26*c* that arcuatedly connects the corresponding first and second linear portions 26*a* and 26*b* to each other, thereby forming the upright portion 20 described above. The first linear portions 26*a* of the pair of elastic pieces 13 are parallel to each other, as a matter of course.

Each of the upright portions 20 formed in the above manner is constituted by the protrusion 23 and a connecting portion 27 formed closer to the protrusion 23 than the bending line 26 of the elastic piece 13. Thus, that portion of the elastic piece 13 from which the connecting portion 27 is excluded, that is, the portion closer to the main body portion 12 than the bending line 26 forms the flat portion 18.

When the elastic pieces 13 are bent at the bending lines 26 each comprised of the first and second linear portions 26*a* and 26*b* and curved portion 26*c*, each of the connecting portions 27 forms a slant portion 28 at its portion as the proximal portion of the protrusion 23 closer to the main body portion 12 to obliquely connect the protrusion 23 and flat portion 18 to each other. More specifically, the slant portions 28 are slanted such that the closer to the protrusions 23, the higher they are above the flat portions 18, and the closer to the main body portion 12, the lower they are above the flat portions 18. In addition, the slant portions 28 are slanted such that the closer to the protrusions 23 with a slant larger than the slant based on the slant of the elastic pieces 13 where they are arranged, the more inner they are, and the closer to the main body portion 12, the more outer they are.

Each of the upright portions 20 has, at its protrusion 23, the contact portion 14 which extends opposite to the main body portion 12 to form a rectangular shape and which is bent such that its intermediate portion in the extending direction is bent toward the other elastic piece 13 while forming a V shape when seen from a direction perpendicular to the main body portion 12. Consequently, the contact portions 14 are formed to oppose each other at the respective distal ends of the pair of elastic pieces 13.

A method of manufacturing the contact 10 with the structure described above will be described.

Figure 7:
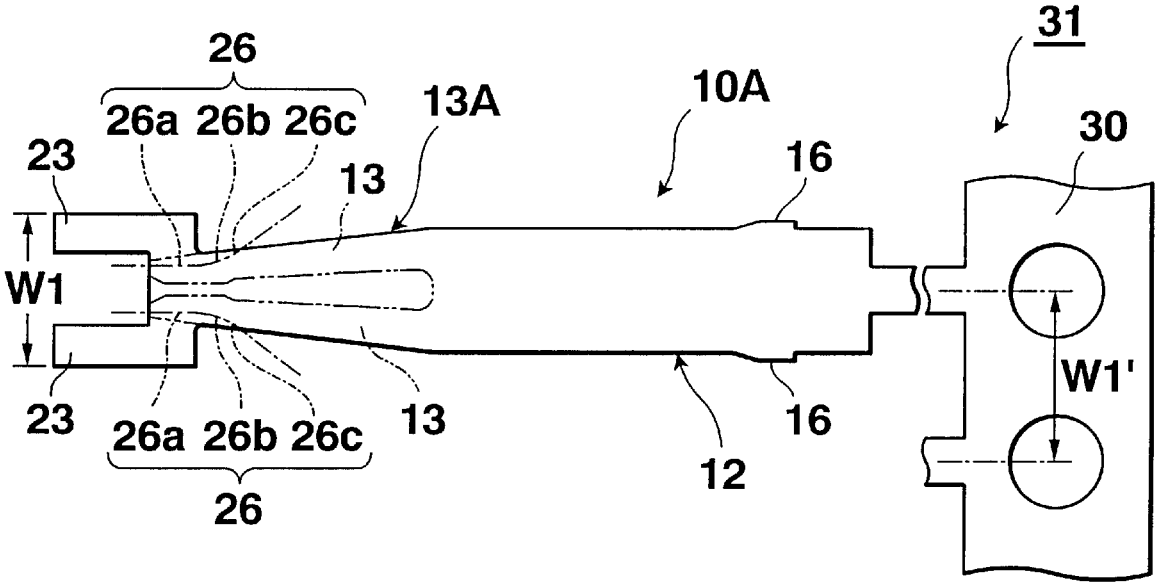
FIG. 7 is a plan view showing a blank for the connector contact shown in FIG. 5.

First, a flat plate member is punched by outer shape punching with a press to form a flat plate-like blank 31 in which a plurality of contact forming portions 10A are aligned and connected to a carrier 30 at their proximal end sides (a side opposite to the protrusions 23), as shown in FIG. 7. In this blank 31, each contact forming portion 10A naturally has a planar shape as a developing form of the contact 10 before bending. A portion between the pair of elastic pieces 13 is not punched out and the elastic pieces 13 are not accordingly separated from each other. More specifically, the contact forming portion 10A has a main body portion 12, an elastic piece forming portion 13A in which a pair of elastic piece proximal portions 22 are connected to each other at their inner sides throughout their entire lengths, and a pair of protrusions 23 projecting outward from two sides in a lateral direction of the elastic piece forming portion 13A opposite to the main body portion 12.

Figure 8:
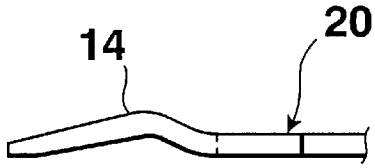
FIG. 8 is a partial enlarged plan view of the connector contact according to the present invention.

Subsequently, the respective protrusions 23 are pressed to form contact portions 14 which are bent in a V shape to bulge on the same side (inner side), as shown in FIG. 8.

Figure 9:
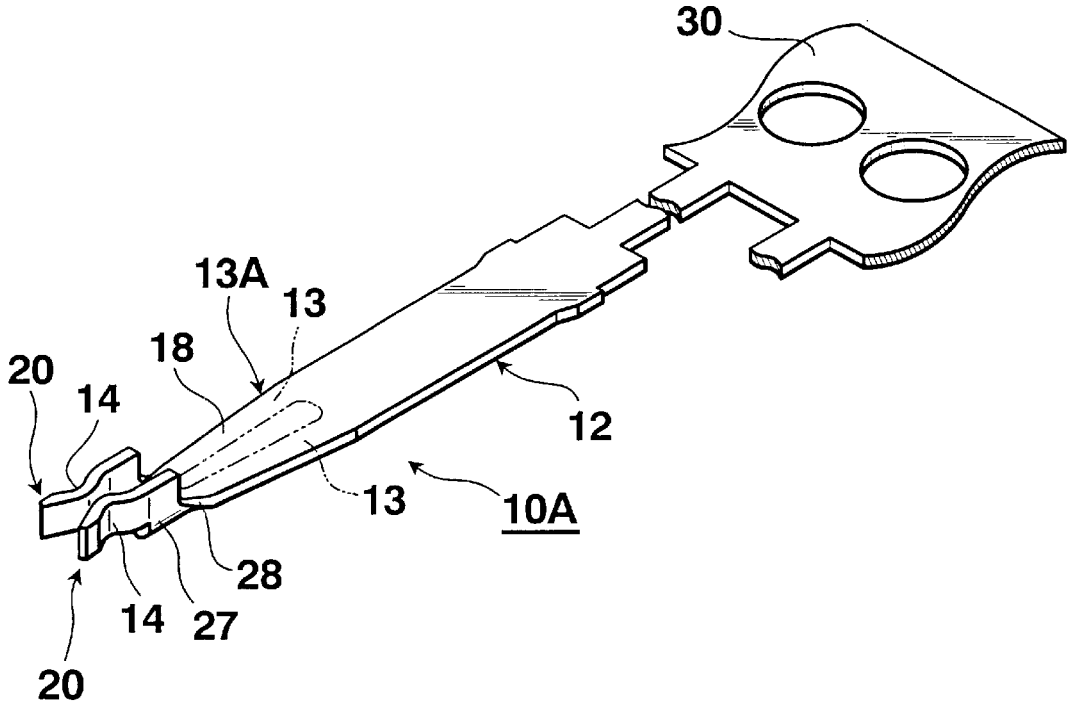
FIG. 9 is a perspective view showing a manufacturing step for the connector contact according to the present invention.

Those portions of the elastic piece forming portion 13A of the contact forming portion 10A which are closer to the protrusions 23 are bent by the press at the bending lines 26, each comprised of the first and second linear portions 26*b* and curved portion 26*c* described above, at 90° toward the bulged sides of the contact portions 14, as shown in FIG. 9, thereby forming the upright portions 20, so that the contact portions 14 oppose each other (more specifically, in this case, the maximum width between the upright portions 20 with respect to a male contact 11 with a width of 0.5 mm is 0.85 mm).

Figure 10:
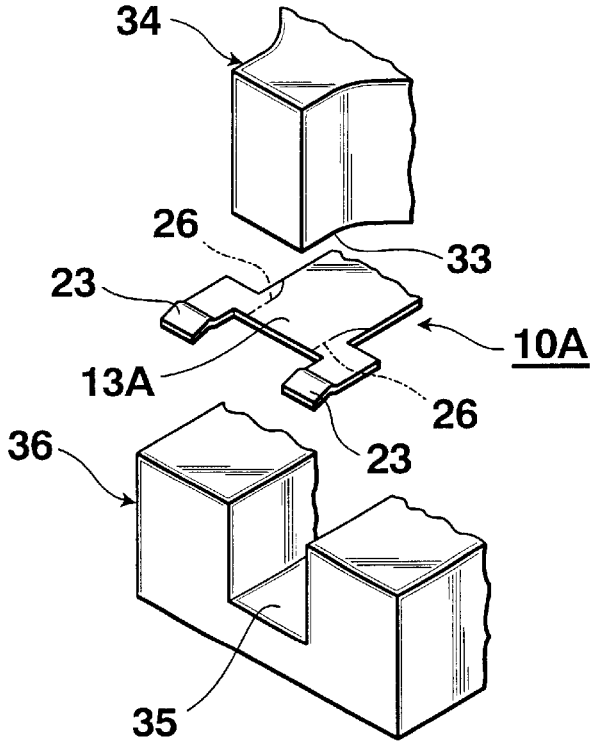
FIG. 10 is a perspective view schematically showing a press step before the step shown in FIG. 9 is reached.

To form the upright portions 20 by this bending deformation, as shown in FIG. 10, a punch 34 with edges 33 formed on its two sides to have shapes matching the bending lines 26, and a die 36 with a recess 35 that can receive the punch 34 with a gap corresponding to the thickness of the contact 10 are used, and the contact forming portion 10A is pressed by pushing it into the recess 35 of the die 36 with the punch 34.

Figure 11:
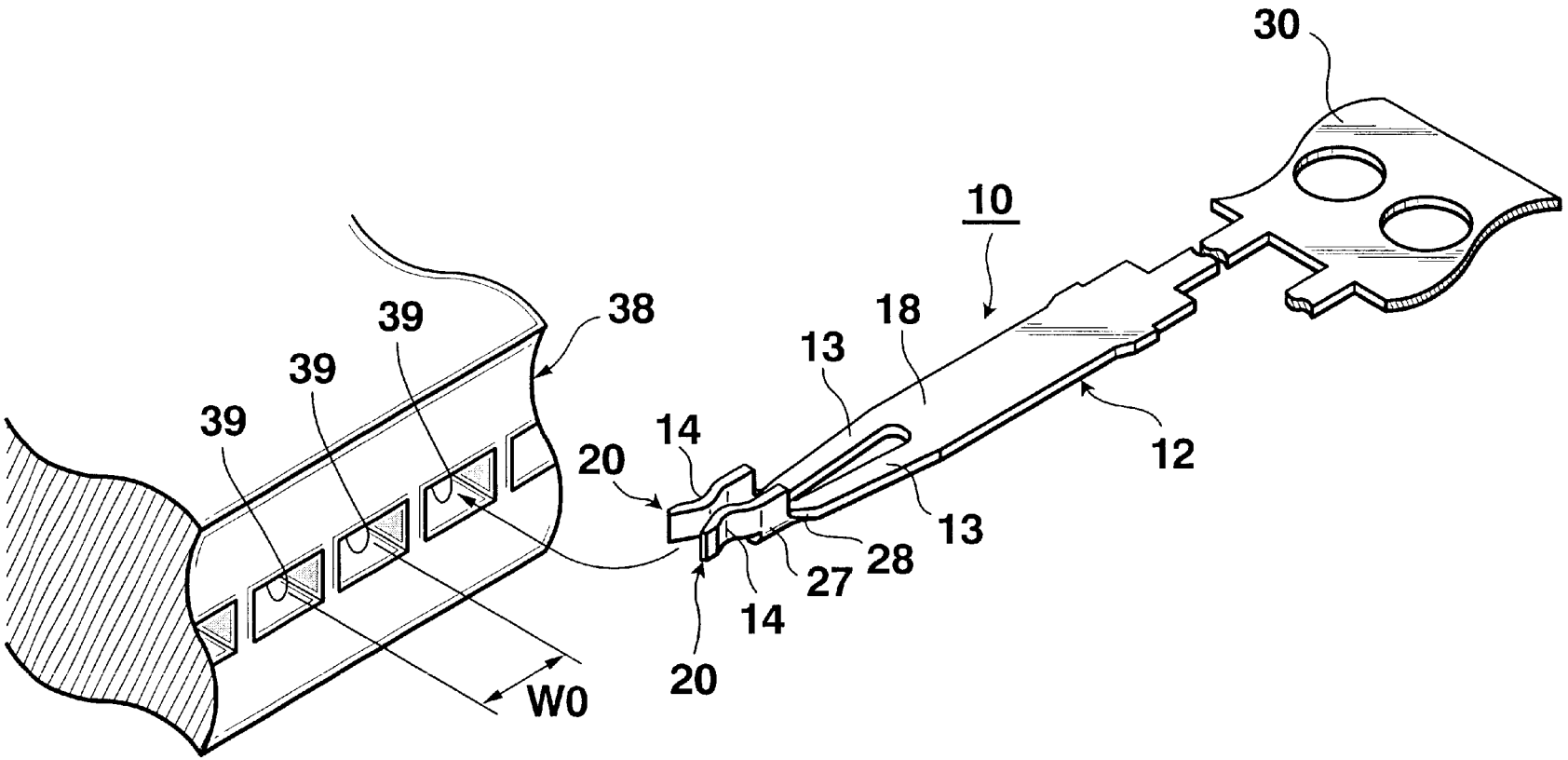
FIG. 11 is a perspective view showing the connector contact according to the present invention before it is inserted in a connector housing.

In this manner, the pair of elastic pieces 13 as the elastic piece forming portion 13A before separation are bent to form the upright portions 20, so the contact portions 14 oppose each other. Then, a portion between the prospective pair of elastic pieces 13 is punched out by the press, to form the pair of elastic pieces 13 separately, as shown in FIG. 11. Thus, the contact forming portion 10A becomes the contact 10.

The plurality of contacts 10 that are lined and connected to each other through the carrier 30 are inserted in a plurality of adjacent holes 39 of a connector housing 38 simultaneously, and after that the individual contacts 10 are separated by cutting.

In connecting connectors to each other, when the male contact 11 is connected to the corresponding contact 10, it enters between the contact portions 14 of the contact 10. Then, the pair of elastic pieces 13 are pushed by the male contact 11 and are elastically deformed in directions to separate from each other, so that the contact portions 14 are separated apart from each other, without changing their postures, at such a width that the male contact 11 can be inserted between them. When the male contact 11 is inserted between the contact portions 14, they are both urged against the male contact 11 by the elastic forces of the elastic pieces 13 on the two sides, and come into good contact with the male contact 11, so that they are electrically connected to it. Since the heights of the contact portions 14 are naturally different from that of the main body portion 12, the male contact 11 can be inserted deep without being interfered by the main body portion 12.

In the contact 10 according to the embodiment described above, the respective distal ends of the pair of elastic pieces 13 extending like beams on the same side from the two sides of the main body portion 12 have protrusions 23 at which the contact portions 14 are to be arranged and each of which projects in the lateral direction opposite to the other elastic piece 13. The pair of elastic pieces 13 are deformed by bending so that the contact portions 14 formed on the respective protrusions 23 oppose each other. Therefore, the main body portion 12 need not be formed to have a U-shaped section, and a width W1 of the contact forming portion 10A in a developed form can be narrowed, as shown in FIG. 7. As a result, a contact pitch W1' in the blank can also be decreased (note that $W1' \geqq W1$). In particular, the protrusions 23 are formed on the distal ends the entire width of which is decreased by slanting the elastic pieces 13 to come close to each other. Even in this embodiment in which the maximum width W1 is determined by the protrusions 23, the width W1 can be reliably decreased. Therefore, even when coping with the connector housing 38 shown in FIG. 11 in which a contact pitch W0 is narrow, the plurality of contacts 10 made from one blank 31 and connected to each other through the carrier 30 can be inserted in the adjacent holes 39 of the connector housing 38 simultaneously (that is, $W1 \leqq W1' = W0$ can be satisfied). As a result, the time required for assembly can be shortened, and the amount of material necessary for forming each contact 10 can be decreased (more specifically, to about ½ the conventional amount), so that cost reduction can be achieved.

The pair of elastic pieces 13 are deformed by bending, so that their contact portions 14 oppose each other. Accordingly, those surfaces of the contact portions 14 with which the contact portions 14 come into contact with the male contact 11 can form high-smoothness rolled surfaces. Hence, the contact portions 14 can come into contact with the male contact 11 with the high-smoothness rolled surfaces.

The respective distal ends of the pair of elastic pieces 13 have protrusions 23 at which the contact portions 14 are to be arranged and each of which projects in the lateral direction opposite to the other elastic piece 13, and the pair of elastic pieces 13 are deformed by bending, so that the contact portions 14 formed on the respective protrusions 23 oppose each other. Accordingly, the contact portions 14 can be arranged at positions (heights) shifted from that of the main body portion 12. Hence, the male contact 11 can have a sufficiently large insertion length.

In addition, each of the pair of elastic pieces 13 is deformed by bending at the corresponding bending line 26 comprised of the first linear portion 26*a* arranged on a side closer to the other elastic piece 13 than the corresponding protrusion 23, the second linear portion 26*b* extending obliquely from the corresponding first linear portion 26*a* on the main body portion 12 side to the outer end of the elastic piece 13 where it is arranged, and the curved portion 26*c* that arcuatedly connects to each other the corresponding first and second linear portions 26*a* and 26*b* that are arranged on the same elastic piece 13. Thus, the contact portions 14 oppose each other. The slant portions 28 can accordingly be formed on the proximal portions of the protrusions 23 closer to the main body portion 12. Hence, the slant portions 28 can prevent stress concentration at the proximal portions of the protrusions 23 and can increase the strength.

As the strength is increased, when the male contact 11 is inserted between the contact portions 14, the contact portions 14 can be separated apart from each other without changing their postures, and consequently they can come into good contact with the male contact 11.

Since each of the elastic pieces 13 is bent at the first linear portion 26*a* arranged more inner than its protrusion 23, the distance between the two protrusions 23 before bending can be further decreased while assuring the heights of the protrusions 23 after bending. This can cope with a further decrease in contact pitch.

According to the method of manufacturing the contact 10 described above, when forming the contact 10, the pair of elastic pieces 13 are bent in the form of the elastic piece forming portion 13A before separation, so the contact portions 14 oppose each other. After that, that portion in the elastic piece forming portion 13A which forms the pair of elastic pieces 13 is punched, thereby separately forming the elastic pieces 13. Thus, when performing bending, the contact 10 can be stably pressed at its wide continuous elastic piece forming portion 13A comprised of the pair of elastic pieces 13 and the portion between them. Therefore, the bending precision can be greatly improved.

Figure 12:
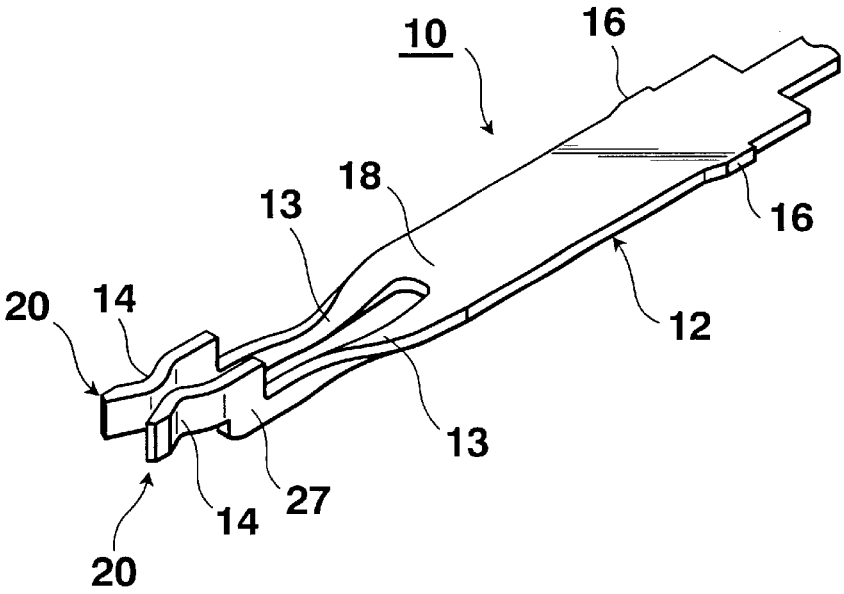
FIG. 12 is a perspective view showing a connector contact according to the second embodiment of the present invention.

In the above embodiment, the upright portions 20 are obtained by bending the pair of elastic pieces 13 so that the contact portions 14 oppose each other. Alternatively, elastic pieces 13 may be deformed by twisting, as shown in FIG. 12. In FIG. 12, a portion between protrusions 23 of the elastic pieces 13 and a main body portion 12 is twisted.

Still, the embodiment described above, in which the contact portions 14 are made to oppose each other by bending the pair of elastic pieces 13, is preferable since the number of steps can be decreased. More specifically, in order to make the contact portions 14 to oppose each other by twisting the elastic pieces 13 with a press, at least two steps of bending each at 45° are necessary. If deformation is performed by bending with the press as in the above embodiment, it can be done in one step.

Bending deformation is preferable because it can assure good precision of the two contact portions 14. More specifically, 50 pieces of contacts in each of which the contact portions 14 are made to oppose each other by twisting the elastic pieces 13, and 50 pieces of contact in each of which the contact portions 14 are made to oppose each other by bending the elastic pieces 13, were manufactured on the trial basis under the same manufacturing conditions, and the distances between the contact portions 14 of the resultant contacts were measured. Table 1 shows the results.

TABLE 1

| | Twisting Deformation | Bending Deformation |
|---|---|---|
| Average Value (mm) | 0.205 | 0.208 |
| Maximum Value (mm) | 0.228 | 0.219 |
| Minimum Value (mm) | 0.182 | 0.189 |
| Standard Deviation | 0.0104 | 0.0022 |

As shown in Table 1, when the contact portions 14 were made to oppose each other by twisting the elastic pieces 13, of the 50 pieces, the average value was 0.205 mm, the maximum value was 0.228 mm, the minimum value was 0.182 mm, and the standard deviation was 0.0104. In contrast to this, when the contact portions 14 were made to oppose each other by bending the elastic pieces 13, of the 50 pieces, the average value was 0.208 mm, the maximum value was 0.219 mm, the minimum value was 0.189 mm, and the standard deviation was 0.0022. Therefore, with bending deformation, the variation decreases to about ⅕ that of twisting deformation, and a stable product quality can be obtained.

Figure 13:
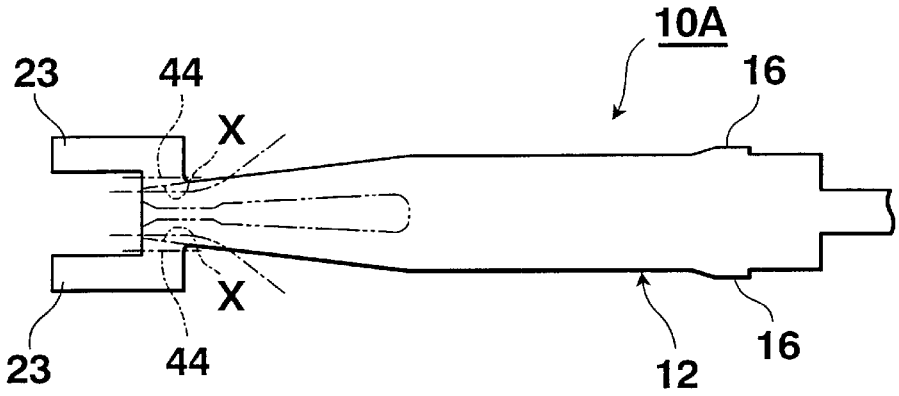
FIG. 13 is a perspective view showing a connector contact according to the third embodiment of the present invention.

As shown in FIG. 13, contact portions 14 may be made to oppose each other by bending a pair of elastic pieces 13 of a contact 10 at linear portions 41 arranged in respective protrusions 23 and parallel to the inserting direction of a male contact 11 (see FIG. 5). In this case, the punch and die of the press can be made with simple shapes, so that the manufacturing cost can be decreased.

Figure 14:
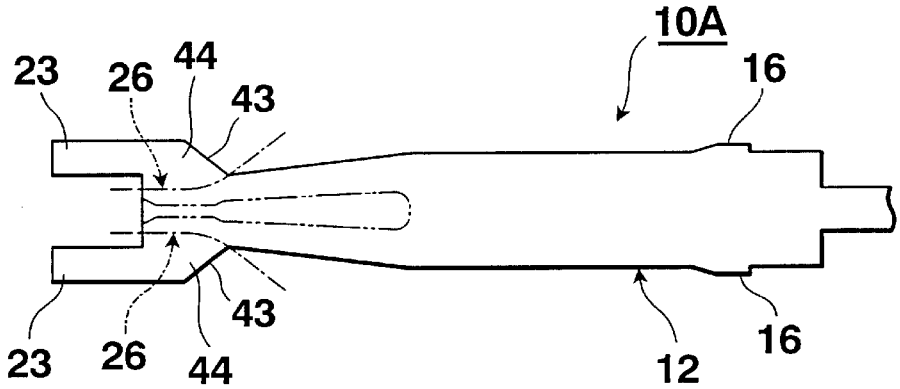
FIG. 14 is a perspective view showing a connector contact according to the fourth embodiment of the present invention.

Alternatively, as shown in FIG. 14, slant portions 44 may be formed on protrusions 23 on sides closer to a main body portion 12, to slant such that the closer to the main body portion 12, the smaller the protruding amount. With this arrangement, stress concentration on the proximal portions of the protrusions 23 can be reliably prevented by the slant portions 44, thereby reliably increasing the strength. As the slant portions 44, ones with slant surfaces 43 which are continuous to the distal end faces of the protruding sides of the protrusions 23, as shown in FIG. 14, are the most preferable from the viewpoint of improving the strength of the protrusions 23.

What is claimed is:

1. A connector contact comprising:

a main body portion having a plurality of sides;

a pair of elastic pieces, each of said elastic pieces separately extending from two sides of said main body portion; and bendable contact portions respectively formed at distal ends of said elastic pieces, to come into contact with a male contact inserted between said bendable contact portions, wherein each of said elastic pieces has, at said distal end thereof, a bendable protrusion substantially adjacent to where a bendable contact portion of said bendable contact portions is formed, said bendable protrusion projecting in a lateral direction opposite to an opposing one of said elastic pieces, and said pair of elastic pieces are deformed by twisting or bending, so that said bendable contact portions oppose each other, each of said elastic pieces has, at said distal end, a planar portion adjacent to a projection extending between the main body portion and said bendable protrusion, said planar portion being located substantially adjacent to said bendable protrusion so as to provide slidable contact between said planar portion and said male contact, and said main body portion has a flat plate shape.

2. A connector contact according to claim 1, wherein said protrusions on said sides closer to said main body portion have slant portions which slant such that the closer to said main body portion, the smaller projecting amounts thereof.

3. A connector contact according to claim 1, wherein said pair of elastic pieces are deformed by bending, so that said contact portions oppose each other.

4. A connector contact according to claim 3, wherein said protrusions on said sides closer to said main body portion have slant portions which slant such that the closer to said main body portion, the smaller projecting amounts thereof.

5. A connector contact according to claim 3, wherein said pair of elastic pieces are deformed by bending at linear portions extending in said protrusions along an inserting direction of said male contact, so that said contact portions oppose each other.

6. A connector contact according to claim 5, wherein said protrusions on said sides closer to said main body portion have slant portions which slant such that the closer to said main body portion, the smaller projecting amounts thereof.

7. A connector contact according to claim 3, wherein each of said pair of elastic pieces is deformed by bending at a first linear portion arranged closer than said protrusion of one elastic piece to the other elastic piece, and a second linear portion extending obliquely from said first linear portion on a side closer to said main body portion to an outer end of said elastic piece, so that said contact portions oppose each other.

8. A connector contact according to claim 7, wherein said protrusions on said sides closer to said main body portion have slant portions which slant such that the closer to said main body portion, the smaller projecting amounts thereof.

9. A connector contact including a main body portion having a plurality of sides, a pair of elastic pieces, each of said elastic pieces extending from two sides of said main body portion, and bendable contact portions respectively formed at distal ends of said elastic pieces, to come into contact with a male contact inserted between said bendable contact portions, wherein said pair of elastic pieces have, at said distal ends, parallel projections and, at distal ends of said projections, bendable protrusions formed substantially adjacent to where said bendable contact portions are formed and which project in a lateral direction opposite to another elastic piece, and said pair of elastic pieces are deformed by twisting or bending, so that said bendable contact portions oppose each other, and wherein said pair of elastic pieces have, at said distal ends, planar portions adjacent to said projections extending between the main body portion and the bendable protrusions, said planar portions being located substantially adjacent to the bendable protrusions.

10. A connector contact including a main body portion having a plurality of sides, a pair of elastic pieces, each of said elastic pieces extending from two sides of said main body portion, and bendable contact portions respectively formed at distal ends of said elastic pieces, to come into contact with a male contact inserted between said bendable contact portions, wherein said pair of elastic pieces have, at said distal ends, parallel projections and, at distal ends of said projections, bendable protrusions formed substantially adjacent to where said bendable contact portions are formed and which project in a lateral direction opposite to another elastic piece, and said pair of elastic pieces are deformed by twisting or bending, so that said bendable contact portions oppose each other, and wherein planar portions of said pair of elastic pieces and said projections are adjacent to each other.

* * * * *